US008755734B2

(12) United States Patent
Abe et al.

(10) Patent No.: US 8,755,734 B2
(45) Date of Patent: Jun. 17, 2014

(54) IMAGE FORMING APPARATUS

(75) Inventors: Kenji Abe, Suntou-gun (JP); Hideki Ohta, Numazu (JP); Takashi Kuwata, Suntou-gun (JP); Youhei Suzuki, Suntou-gun (JP); Takamichi Matsuo, Suntou-gun (JP); Toshiaki Sako, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 490 days.

(21) Appl. No.: 12/905,198

(22) Filed: Oct. 15, 2010

(65) Prior Publication Data

US 2011/0103808 A1 May 5, 2011

(30) Foreign Application Priority Data

Oct. 30, 2009 (JP) ..... 2009-251391

(51) Int. Cl.
*G03G 15/00* (2006.01)

(52) U.S. Cl.
USPC ..... 399/401; 399/364

(58) Field of Classification Search
USPC ..... 399/401, 364, 94, 44
See application file for complete search history.

(56) References Cited

U.S. PATENT DOCUMENTS

| | | | | |
|---|---|---|---|---|
| 6,219,521 | B1 | 4/2001 | Burdick et al. | |
| 7,515,841 | B2 * | 4/2009 | Kato et al. | 399/44 |
| 7,734,208 | B2 * | 6/2010 | Seo et al. | 399/69 |
| 7,819,516 | B2 | 10/2010 | Groenenberg et al. | |
| 8,050,578 | B2 * | 11/2011 | Kurokawa | 399/44 |
| 2002/0097428 | A1 * | 7/2002 | Ferlitsch | 358/1.15 |
| 2004/0037601 | A1 * | 2/2004 | Uchida et al. | 399/396 |
| 2009/0047521 | A1 | 2/2009 | Groenenberg et al. | |
| 2009/0080926 | A1 * | 3/2009 | Kurokawa | 399/69 |
| 2009/0116866 | A1 | 5/2009 | Hollands et al. | |

FOREIGN PATENT DOCUMENTS

| | | | |
|---|---|---|---|
| CN | 1440519 | A | 9/2003 |
| CN | 101426655 | A | 5/2009 |
| EP | 0 526 714 | A1 | 2/1993 |
| JP | 8-254938 | A | 10/1996 |
| JP | 2002278354 | A | 9/2002 |
| JP | 2005-215229 | A | 8/2005 |
| JP | 2006323411 | A | 11/2006 |

OTHER PUBLICATIONS

Chinese Office Action dated Jul. 20, 2012, in counterpart Chinese Application No. 201010530266.9, and English-language translation thereof.

* cited by examiner

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

An image forming apparatus includes: a sheet feed unit that feeds a sheet to an image forming unit forming a toner image on the sheet; a fixing unit that fixes the toner image formed in the image forming unit to the sheet; and a control unit that controls the sheet feed unit, when starting duplex image formation for forming both sides of the sheet after an one-side image formation, the control unit retards a timing to cause the sheet feed unit to start the sheet feed operation as the number of sheet with an image formed on one side thereof in the one-side image formation is greater.

14 Claims, 13 Drawing Sheets

IMAGE FORMING APPARATUS

BACKGROUND OF THE INVENTION

1. Field of the Invention

The present invention relates to an image forming apparatus, and specifically relates to an image forming apparatus that prevents image quality deterioration caused by condensation of water vapor generated from sheets when fixing a toner image thereto.

2. Description of the Related Art

Conventionally, in electrographic image forming apparatuses such as copiers, printers and facsimile machines, when forming an image on a sheet, first, a toner image formed in an image forming unit is transferred to a sheet. Subsequently, the toner image is fixed to the sheet by means of heating and pressurization using a fixing unit, thereby forming an image on the sheet.

Example of such image forming apparatus include an image forming apparatus including a re-transport unit for reversing a sheet with a toner image fixed to one side thereof and transporting the sheet to an image forming unit again. In two-side printing for forming an image on two sides of a sheet, a sheet with a toner image fixed to one side thereof is reversed by the re-transport unit, and is transported again to the image forming unit, thereby forming an image on the back side of the sheet.

Examples of the fixing unit include a thermal pressure fixing-type fixing unit including a fixing roller and a pressure roller, the fixing unit applying heat and pressure to a sheet simultaneously by means of the fixing roller and the pressure roller, thereby fixing a toner image to the sheet. In the case of such fixing unit, when fixing a toner image to a sheet, a considerable amount of heat is applied from the fixing roller, which heats the sheet, to the sheet. Accordingly, in the toner image fixing, moisture contained in the sheet evaporates, generating water vapor.

When water vapor is generated, if the temperature of the image forming apparatus body subsequently becomes relatively low, water vapor may condense in a sheet transport path. Upon occurrence of condensation, when a sheet passes through the sheet transport path, droplets adhere to the sheet. In order to prevent condensation, conventional image forming apparatuses include a fixing unit with an enhanced air tightness to absorb water vapor within the fixing unit. Another example of a conventional image forming apparatus is configured to discharge generated water vapor to the outside of the apparatus via a louver provided at an upper portion of the image forming apparatus (see Japanese Patent Application Laid-Open No. H08-254938).

In conventional image forming apparatuses, with an increase in speed in recent years, an amount of heat transferred from the fixing roller to a sheet is also increased, resulting in an increase in an amount of generated water vapor itself. The conventional configuration that enhances the air tightness of the fixing unit, thereby absorbing water vapor within the fixing unit has a limit on the water vapor absorption, causing difficulty in water vapor collection.

When water vapor is insufficiently discharged and collected, if the temperature of the image forming apparatus body becomes relatively low, for example, in two-side printing, water vapor condenses on a guide member that guides a reversed sheet. In recent years, for downsizing and enhanced two-side printing productivity of the image forming apparatuses, a switchback roller pair provided in a re-transport unit to reverse and transport a sheet is arranged in the vicinity of the fixing unit in some cases. In this case, water vapor condenses also on the surface of the switchback roller pair.

Upon occurrence of condensation, for example, when two-side printing is performed in a condition in which the image forming apparatus body is not sufficiently warmed up, like in the case of a cold start, water vapor condensing on the guide member and the switchback roller pair adheres to a sheet, which is to be reversed and transported, in the form of droplets. When droplets adhere to a sheet, the electric resistance value of the part of the sheet surface to which the droplets adhere is lowered compared to the surrounding part of the sheet surface to which no droplets adhere, which may cause image dropouts during transfer of a toner image in a transfer unit.

SUMMARY OF THE INVENTION

The present invention has been made in view of the above-mentioned existing circumstances, and provides an image forming apparatus capable of preventing image quality deterioration caused by condensation in two-side image formation.

An image forming apparatus according to the present invention includes: a sheet feed unit that feeds a sheet to an image forming unit forming a toner image on the sheet; a fixing unit that fixes the toner image to the sheet; a re-transport unit that reverses the sheet with the toner image and re-transports the sheet to the image forming unit when forming an image on both sides of the sheet; and a control unit that controls a sheet feed operation of the sheet feed unit, wherein, when starting duplex image formation for forming an image on both sides of a sheet after an one-side image formation for forming an image on one side of a sheet, as the number of the sheet with the image formed on the one side thereof in the one-side image formation is greater, the control unit retards a timing to cause the sheet feed unit to start the sheet feed operation.

Also, an image forming apparatus according to the present invention includes: a sheet feed unit that feeds a sheet to an image forming unit forming a toner image on the sheet; a fixing unit that fixes the toner image to the sheet; a re-transport unit that reverses the sheet with the toner image and re-transports the sheet to the image forming unit; and a control unit that controls a sheet transport operation of the re-transport unit, wherein, when performing duplex image formation for forming an image on both sides of a sheet after an one-side image formation for forming an image on one side of a sheet, the control unit controls the re-transport unit so as to temporarily halt the sheet on the both sides of which the toner image is to be formed in the re-transport unit or to decrease a sheet transport speed.

The present invention enables prevention of image quality deterioration caused by condensation in two-side image formation.

Further features of the present invention will become apparent from the following description of exemplary embodiments with reference to the attached drawings.

DESCRIPTION OF THE EMBODIMENTS

Figure 1:
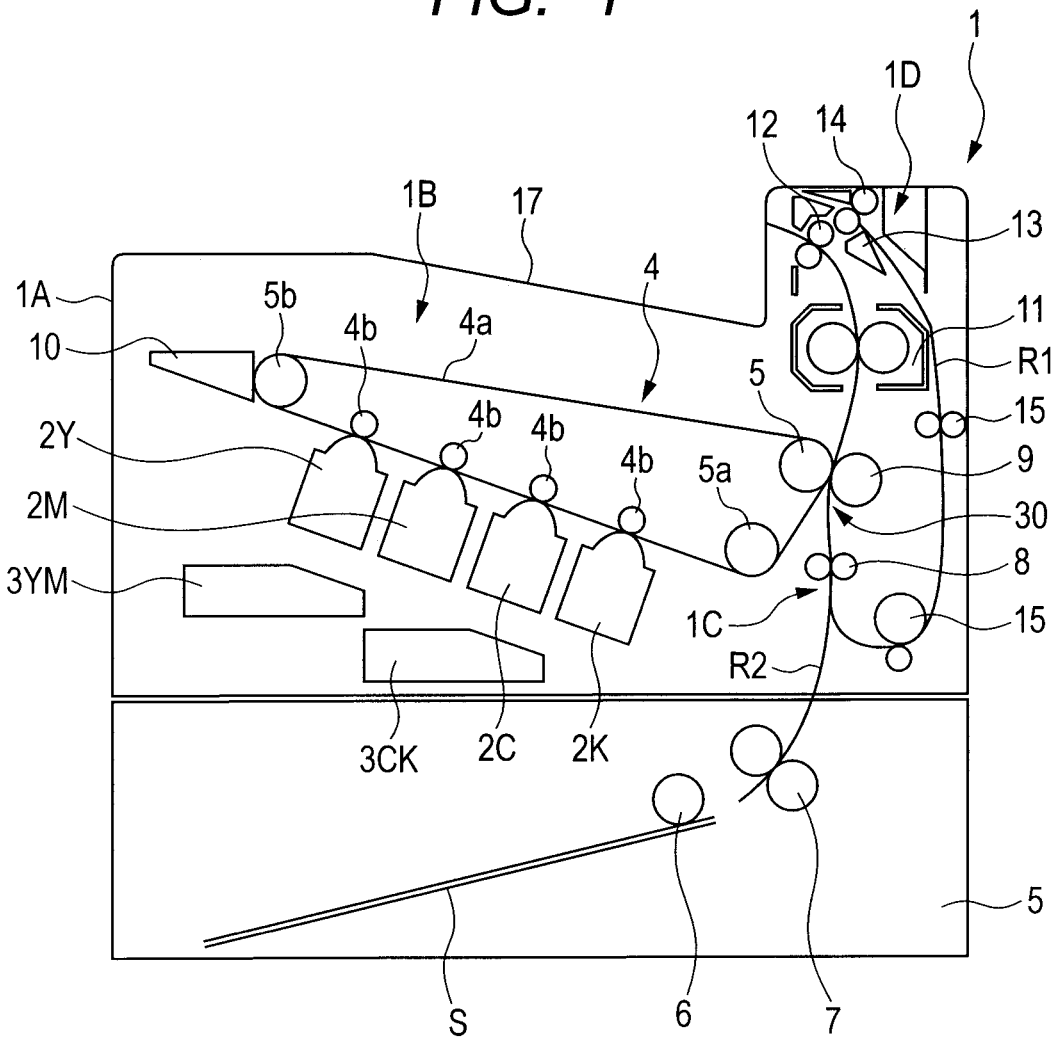
FIG. 1 illustrates a schematic configuration of a full color laser printer, which is an example of an image forming apparatus according to a first embodiment of the present invention.

Embodiments of the present invention will be described in detail below with reference to the drawings. FIG. 1 illustrates a schematic configuration of a full color laser printer, which is an example of an image forming apparatus according to a first embodiment of the present invention. In FIG. 1, a full color laser beam printer 1, a full color laser beam printer body (hereinafter referred to as "printer body") 1A, an image forming unit 1B that forms toner images, a sheet transport unit 1C, a feed cassette unit 5 and a fixing unit 11 are illustrated.

The image forming unit 1B includes scanner units 3 (3YM and 3CK), and four process cartridges 2 (2Y, 2M, 2C and 2K) for forming toner images of four colors: yellow (Y), magenta (M), cyan (C) and black (Bk). The image forming unit 1B also includes an intermediate transfer unit 4 arranged above the process cartridges 2. Each process cartridge 2 includes a photosensitive drum, which is an image bearing member (not illustrated) for forming a toner image.

The intermediate transfer unit 4 includes an intermediate transfer belt 4*a* wrapping around a drive roller 5, a tension roller 5*a* and a driven roller 5*b*. The intermediate transfer unit 4 includes primary transfer rollers 4*b* provided inside the intermediate transfer belt 4*a*, which are brought into contact with the intermediate transfer belt 4*a* at positions facing the photosensitive drums. The intermediate transfer belt 4*a* is constructed of a film-like member and is arranged so as to be in contact with the respective photosensitive drums, and rotates in the direction of the arrow (counterclockwise) by means of the drive roller 5 that is driven by a drive unit (not illustrated).

A positive transfer bias is applied to the intermediate transfer belt 4*a* by means of the primary transfer rollers 4*b*. Negatively-charged toner images for respective colors on the photosensitive drums are sequentially transferred to the intermediate transfer belt 4*a* in a superimposed manner. Consequently, a full color image is formed on the intermediate transfer belt. At a position facing the drive roller 5 in the intermediate transfer unit 4, a secondary transfer roller 9, which is included in a secondary transfer unit 30 that transfers the full color image formed on the intermediate transfer belt to a sheet S, is provided. The sheet transport unit 1C transports a sheet to the secondary transfer unit 30.

The fixing unit 11 is arranged above the secondary transfer roller 9, and a delivery roller pair 12 and a switching member 13 are arranged above the fixing unit 11. The delivery roller pair 12, which is a delivery unit, delivers a sheet with an image fixed thereto to the outside of the apparatus. A re-transport unit 1D includes a switchback roller pair 14 as sheet reverse and transport rollers (reverse and transport unit) capable of normal and reverse rotation. The switchback roller pair 14 is arranged above the fixing unit. The switching member 13, which is swingably supported, selectively guides a sheet with an image fixed thereto by the fixing unit 11 to one of the delivery roller pair 12 and the switchback roller pair 14. A sheet reversed by the re-transport unit 1D is transported by the sheet transport unit 1C to the secondary transfer unit 30 again.

In FIG. 1, the re-transport unit 1D includes a re-transport path R1 for reversing a sheet from one side to the back side and guiding the sheet to the image forming unit 1B again in two-side printing (two-side image formation) in which an image is formed on the back side (second side) of the sheet with an image formed on the one side (first side) thereof by the image forming unit 1B. Then, a plurality of sheet re-feed roller pairs 15, which is included in the sheet transport unit 1C, is provided on the re-transport path R1.

An image forming operation of the full color laser beam printer 1 configured as described above will be described. Upon start of an image forming operation, first, the scanner unit 3 irradiates laser light (not illustrated) based on image information from, such as a personal computer (not illustrated) to sequentially expose the surfaces of the photosensitive drums, which are uniformly charged to have a predetermined polarity and potential, thereby forming an electrostatic latent image on each of the photosensitive drums. Subsequently, the electrostatic latent images are developed using toner and visualized.

For example, first, laser light from the scanner unit 3YM according to an image signal for a yellow color component is applied to the photosensitive drum in the process cartridge 2Y for yellow, thereby forming an electrostatic latent image for yellow on the photosensitive drum. The electrostatic latent image for yellow is developed using yellow toner from a developer unit and thereby visualized as a yellow toner image. Subsequently, the yellow toner image reaches a primary transfer unit where the photosensitive drum and the intermediate transfer belt 4*a* are in contact with each other, with rotation of the photosensitive drum. The toner image on the photosensitive drum is transferred to the intermediate transfer belt 4*a* by means of the primary transfer bias applied to the primary transfer roller 4*b*.

Next, a part of the intermediate transfer belt 4*a*, which bears the yellow toner image, is moved. Before this movement, a magenta toner image is formed on the photosensitive drum of the process cartridge 2M for magenta with a method similar to the above. The magenta toner image is transferred to the intermediate transfer belt 4*a* on the yellow toner image. Similarly, as the intermediate transfer belt 4*a* moves, a cyan toner image and a black toner image are transferred so as to superimpose the yellow and magenta toner images in the primary transfer unit. Consequently, a full color toner image is formed on the intermediate transfer belt.

In parallel to the toner image forming operation, the feed cassette unit 5 sends out sheets S set therein by means of a pickup roller 6. Subsequently, the sheets S are separated one by one by means of a feed/retard roller 7 and transported to a registration roller pair 8. At that moment, the registration roller pair 8 halts, and a sheet S is brought into contact with a nip portion of the registration roller pair 8 in a halt state to form a loop of the sheet S, thereby correcting skewing of the sheet S. In the present embodiment, the feed cassette unit 5 and the registration roller pair 8 are included in a sheet feed unit that feeds a sheet S to the image forming unit 1B.

After the correction of the skewing of the sheet S, the registration roller pair 8 is driven at a timing for aligning the position of the full color toner image on the intermediate transfer belt and the position of the sheet S in the secondary transfer unit 30. The sheet S is transported to the secondary transfer unit 30. In the secondary transfer unit 30, the full color toner image is transferred to the sheet at a time by means of a secondary transfer bias applied to the secondary transfer roller 9. The waste toner, which was not secondary transferred to the sheet S, is collected by a cleaning unit 10, which is provided on the intermediate transfer belt.

The sheet S with the full color toner image transferred thereto is transported to the fixing unit 11. In the fixing unit 11, toner of the respective colors are fused and mixed upon receipt of heat and pressure, and fixed to the sheet S as a full color image.

In the case of one-side printing for forming an image only on one side of a sheet (one-side image formation mode), the sheet S with an image fixed thereto is delivered to an delivery tray 17 by means of an delivery roller pair 12 provided on the downstream side in a sheet transport direction of the fixing unit 11. In the case of one-side printing, the sheet with an image fixed thereto by the fixing unit 11 is delivered to the outside of the apparatus without passing through the re-transport unit 1D.

Figure 2A:
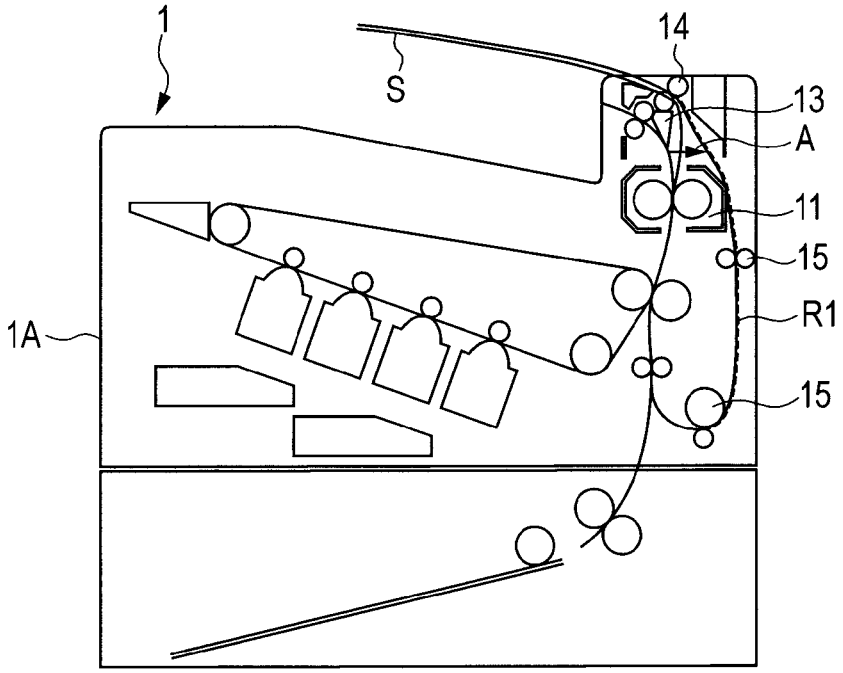
FIGS. 2A and 2B illustrate a sheet transport operation in two-side printing in the full color laser printer.

An operation for the case of two-side printing (duplex image formation mode) for forming an image on both sides of a sheet S will be described. As illustrated in FIG. 2A, the switching member 13 is rotated clockwise by means of, e.g., a solenoid (not illustrated), thereby changing the sheet transport route from the delivery roller pair 12 side to the re-transport unit side. A sheet S with an image formed on one side thereof is guided to the switchback roller pair 14, and transported by a certain amount toward the delivery tray 17 by the switchback roller pair 14.

Figure 2B:
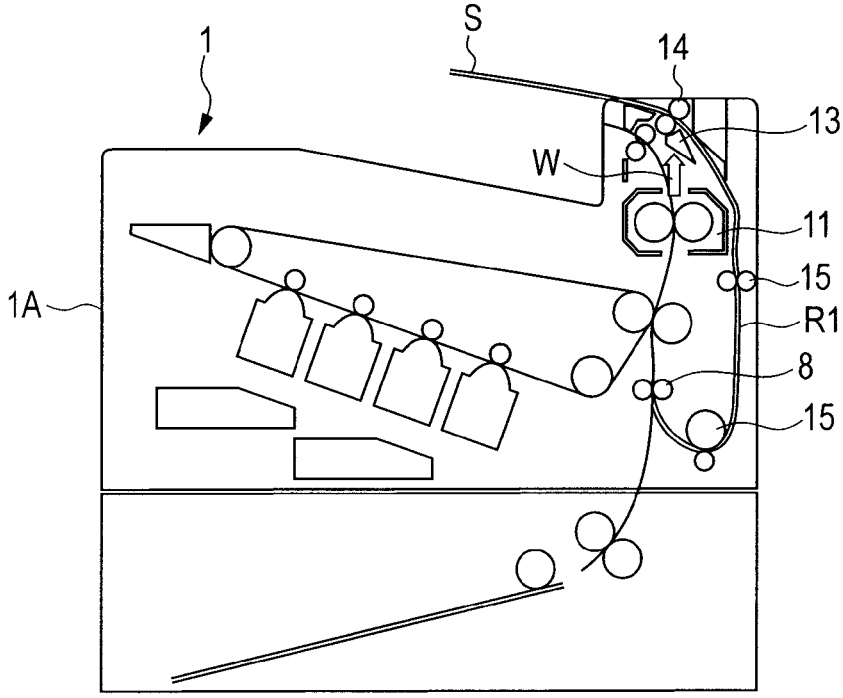

After the sheet S is transported by a certain amount and the trailing edge of the sheet S passes by the switching member 13, the switchback roller pair 14 is halted temporarily, and the switching member 13 is rotated in the direction of arrow A. Subsequently, the switchback roller pair 14 is reversely rotated, thereby the sheet S proceeding onto the re-transport path R1 as illustrated in FIG. 2B. The sheet S is transferred by the sheet re-feed roller pairs 15, and reaches a junction with a sheet transport path R2 in which a sheet S from the pickup roller 6 is transported. The sheet S is transferred to the secondary transfer unit 30 via the registration roller pair 8. An image is transferred to the back side of the sheet S in the secondary transfer unit 30. Subsequently, the image is fixed to the back side of the sheet S in the fixing unit 11, and the sheet S is delivered to the delivery tray 17 via the delivery roller pair 12.

When fixing the toner image in the fixing unit 11, moisture contained in the sheet S evaporates owing to heating by the fixing unit 11 and turns into water vapor. As illustrated in FIG. 2B, the water vapor W is convected upwardly by warm air. The water vapor W adheres to, e.g., a feed guide, the switchback roller pair 14 and the switching member 13 around there, and condenses when the temperature of the printer body (apparatus body) 1A becomes relatively low. When the water vapor W condenses, water adheres to the sheet S if two-side printing is performed. In particular, in the case of a cold start, water adherence to the switchback roller pair 14, which does not rotate in one-side printing and the switching member 13 provided above the fixing unit 11 is significant.

Since the amount of the water vapor W is proportional to the number of sheets to be subjected to one-side printing, as the number of sheets subjected to one-side printing increases, the amount of condensation on the switchback roller pair 14, etc., increases. The number of sheets subjected to one-side printing increases, the printer body 1A is warmed up more. When the printer body 1A is warmed up, the water vapor condensation evaporates. In other words, even though the water vapor temporarily condenses, the condensation on the switchback roller pair 14, etc., disappears as the printer body 1A is warmed up.

Figure 8:
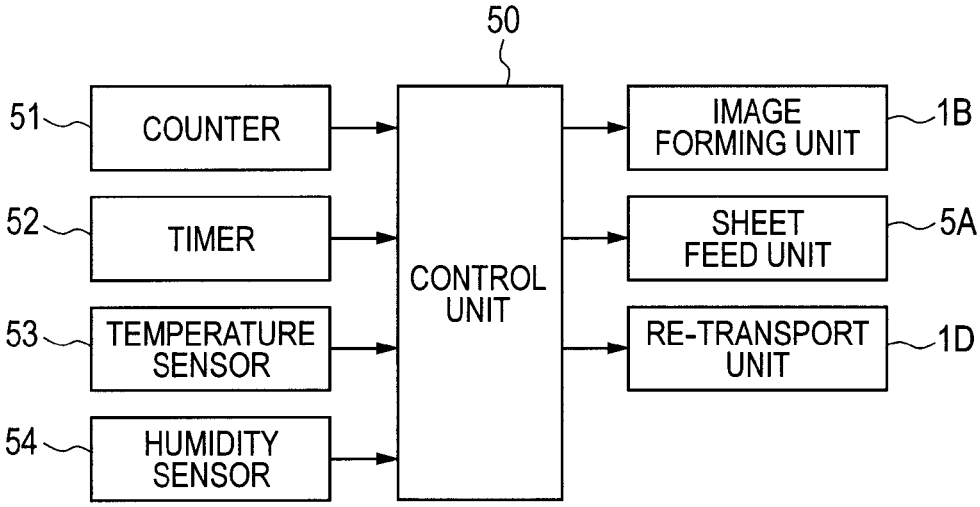
FIG. 8 illustrates a control block diagram of the image forming apparatus.

In the present embodiment, when forming an image on the back side of a sheet after one-side printing in a state in which the water vapor W condenses on the switchback roller pair 14, etc., the sheets are made to wait according to the number of sheets in the one-side printing, and then, two-side printing is started. More specifically, a timing for starting a sheet feed operation by a sheet feed unit 5A including the feed cassette unit 5 and the registration roller pair 8 illustrated in the later-described FIG. 8, is retarded according to the number of sheets in one-side printing.

In the present embodiment, a sheet feed operation refers to an operation for sending out one sheet from a stack of sheets using the pickup roller 6 and the feed/retard roller 7 of the feed cassette unit 5. In the present embodiment, a timing for sending out one sheet from a stack of sheets using the pickup roller 6 and the feed/retard roller 7 of the feed cassette unit 5 is changed according to the number of sheets in one-side printing.

The following mode for changing a timing for a sheet feed operation to feed a sheet to the image forming unit 1B by means of the sheet feed unit 5A may also be employed. A sheet sent out of the feed cassette unit 5 is halted temporarily before the image forming unit 1B, for example, at the registration roller pair 8. Then, the timing for sending out the sheet toward the image forming unit 1B using the registration roller pair 8 is changed according to the number of sheets in one-side printing.

Figure 3:
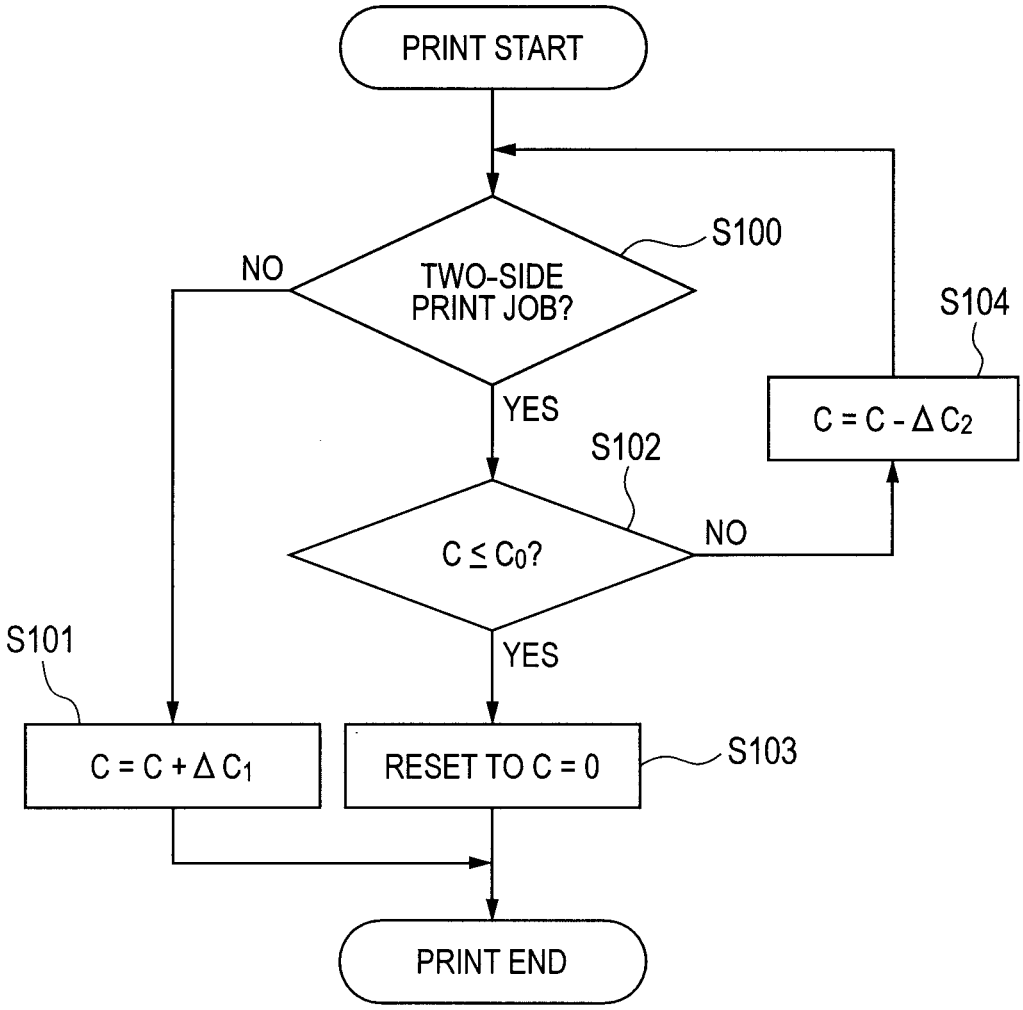
FIG. 3 illustrates a sequence, according to an amount of generated water vapor, for performing an image forming operation for two-side printing after the end of an image forming operation for one-side printing in the full color laser printer.

A sequence, according to an amount of generated water vapor W, for performing an image forming operation for two-side printing after the end of the image forming operation for one-side printing in the present embodiment will be described with reference to FIG. 3. In the present embodiment, a counter value C is defined as a parameter representing an amount of water vapor W generated within the printer body.

When the printer body 1A accepts a print job, a control unit 50, which controls, e.g., an image forming operation of the image forming unit 1B and driving of the feed cassette unit 5, which is illustrated in the later-described FIG. 8, determines whether the accepted print job is a one-side print job or a two-side print job (S100). If the accepted print job is a one-side print job (No in S100), the control unit 50 adds a value of $\Delta C_1$, which is the amount of water vapor per unit sheet count, to a counter value C of a counter 51, which is illustrated in the later-described FIG. 8, for printing on every sheet. Consequently, the counter value C has a value of to $C+\Delta C_1$ (S101). After the water vapor generation amount $\Delta C_1$ is added to the counter value C according to the number of sheets in the print job, the printing is terminated.

If the accepted print job is a two-side print job (Yes in S100), the control unit 50 determines whether or not the counter value C is less than or equal to a threshold value $C_0$, which is a pre-set criterion for starting a two-side print job, that is, $C \leq C_0$ (S102). Then, if the counter value C is less than or equal to the threshold value $C_0$ (Yes in S102), a two-side print job is carried out. Subsequently, after the end of the two-side print job, the control unit 50 resets the counter value C, that is, sets the counter value C to 0 (S103), and the printing is terminated.

If the counter value C exceeds the threshold value $C_0$ (No in S102), this means that water vapor W condenses on the switchback roller pair 14, etc. Accordingly, the control unit 50 deducts a value $\Delta C_2$, which is a condensation evaporation amount per unit time, from the counter value C without carrying out the two-side print job. Consequently, the counter value C has a value of $C-\Delta C_2$ (S104).

Figure 4:
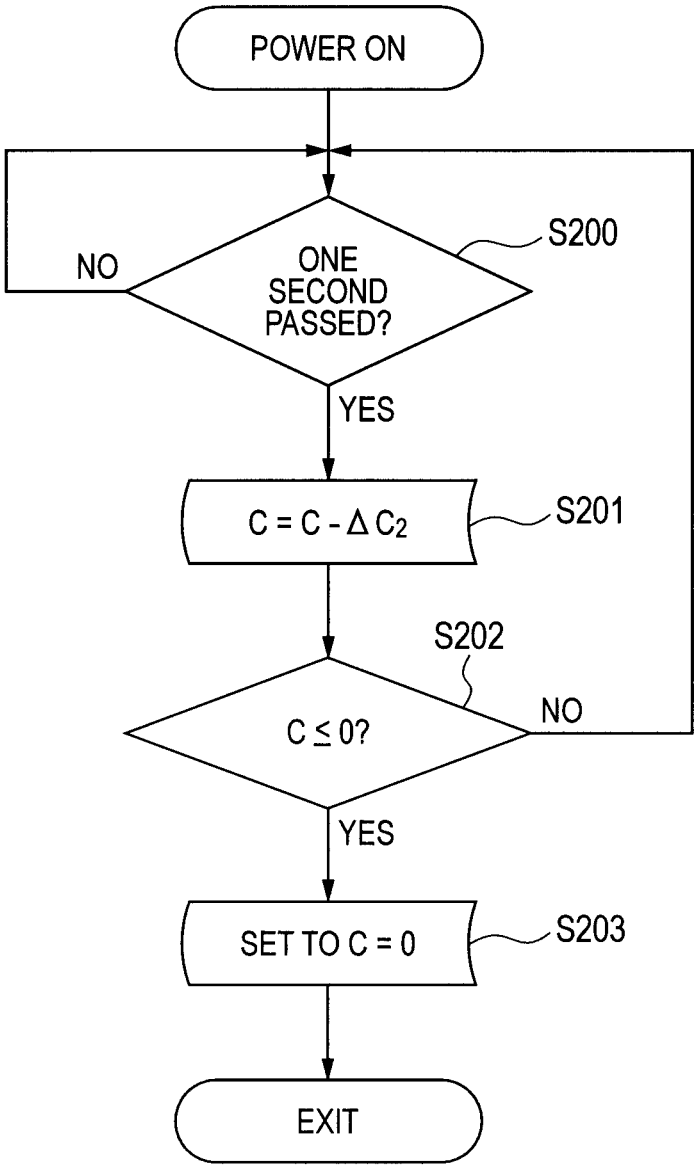
FIG. 4 illustrates control of a counter value indicating an amount of water vapor, according to a condensation evaporation amount.

In the present embodiment, simultaneously with power-on of the printer body 1A, the control unit 50 starts a timer 52, which illustrated in the later-described FIG. 8. Upon the power-on, the printer body 1A starts warming. Subsequently, passage of one second is detected by the timer 52 regardless of whether or not a print operation is underway as illustrated in FIG. 4 (Yes in S200), the control unit 50 deducts the value $\Delta C_2$ from the counter value C. Consequently, the counter value C has a value of $C-\Delta C_2$ (S201). The control unit 50 determines whether or not the deducted counter value C is less than or equal to 0, that is, $C \leq 0$ (S202). If $C \leq 0$ (Yes in S202), the control unit 50 sets the counter value C to 0 (S203). If it is not the case that $C \leq 0$ (No in S202), the control unit 50 deducts the condensation evaporation amount $\Delta C_2$ from the counter value C again after the passage of one second in a manner similar to the above.

The sequence illustrated in FIG. 4 constantly operates according to the passage of time regardless of print operations in the printer body 1. The sequence enables accurate estimation of a water vapor amount considering the natural phenomenon of water vapor condensation evaporating over time even when the printer body 1 is in a standby state.

Figure 5:
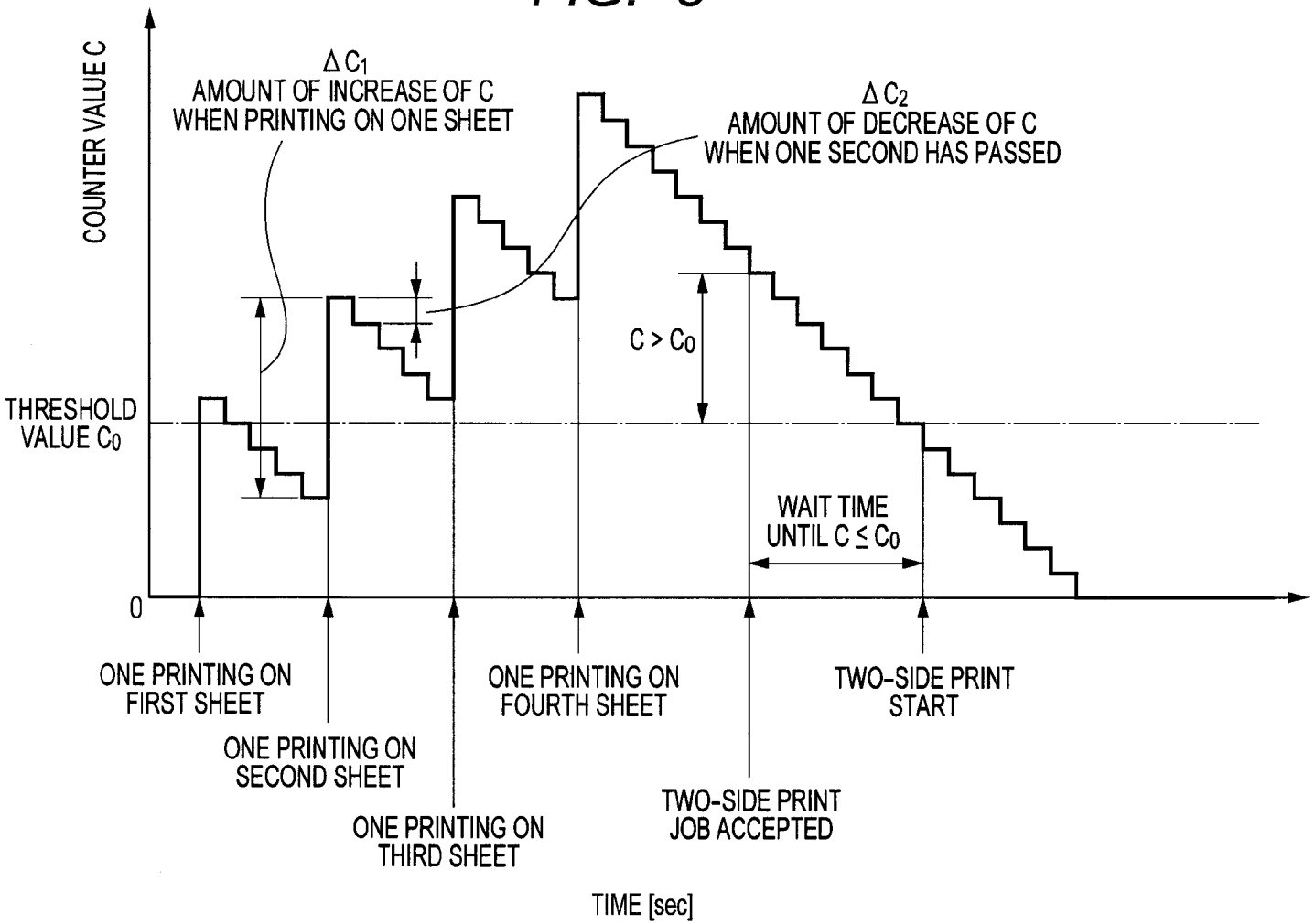
FIG. 5 illustrates changes in a water vapor amount in the full color laser printer.

FIG. 5 is a diagram illustrating changes in an amount of water vapor generated within the printer body 1 according to the present sequence. FIG. 5 illustrates a case where a two-side print job is accepted after one-side printing being performed for four consecutive sheets. As illustrated in FIG. 5, in a standby state, no print operation is performed and time merely advances, and thus, the counter value C is set to 0 according to the above-described sequence illustrated in FIG. 4.

When one-side printing is performed, the water vapor generation amount $\Delta C_1$ per unit sheet count is added to the counter value C, which is set to 0, for printing on every sheet. The condensation evaporation amount $\Delta C_2$ per unit time is deducted from the counter value C according to the passage of time immediately after the printing. When one-side printing is consecutively performed for a plurality of sheets, the relationship between the counter value C and the threshold value $C_0$ is $C>C_0$ as illustrated in FIG. 5. This state occurs as a result of the one-side print job, resulting in water vapor condensing on the switchback roller pair 14 and the switching member 13.

Even though a two-side print job is accepted in this state, the control unit 50 does not start the two-side print job until the counter value C is less than or equal to the threshold value $C_0$, which is the criterion for starting a two-side print job, that is, the relationship is $C \leq C_0$. In other words, when $C>C_0$, even though a two-side print job is accepted, the control unit 50 does not start two-side printing until predetermined wait time for becoming the relationship $C<C_0$ has passed. More specifically, the control unit 50 does not start a sheet feed operation by means of the feed cassette unit 5. In a state in which water vapor condenses, predetermined wait time is provided to retard a timing for the feed cassette unit 5 to start feeding a sheet, compared to that in the case of the preceding one-side print job.

In one-side image formation, a sheet feed operation is started at predetermined time intervals (at every predetermined timing). In one-side image formation, an interval between sheets is a predetermined interval. When two-side image formation for forming an image on both sides of a sheet is started in a state in which water vapor condenses after the end of one-side image formation, an operation will be performed as described below. In other words, after the end of the last sheet feed operation for the one-side image formation, a sheet feed operation is started after the passage of predetermined wait time so as to be later than the predetermined timing. The predetermined wait time is optimum time according to the number of sheets in the last one-side print job.

Figure 6:
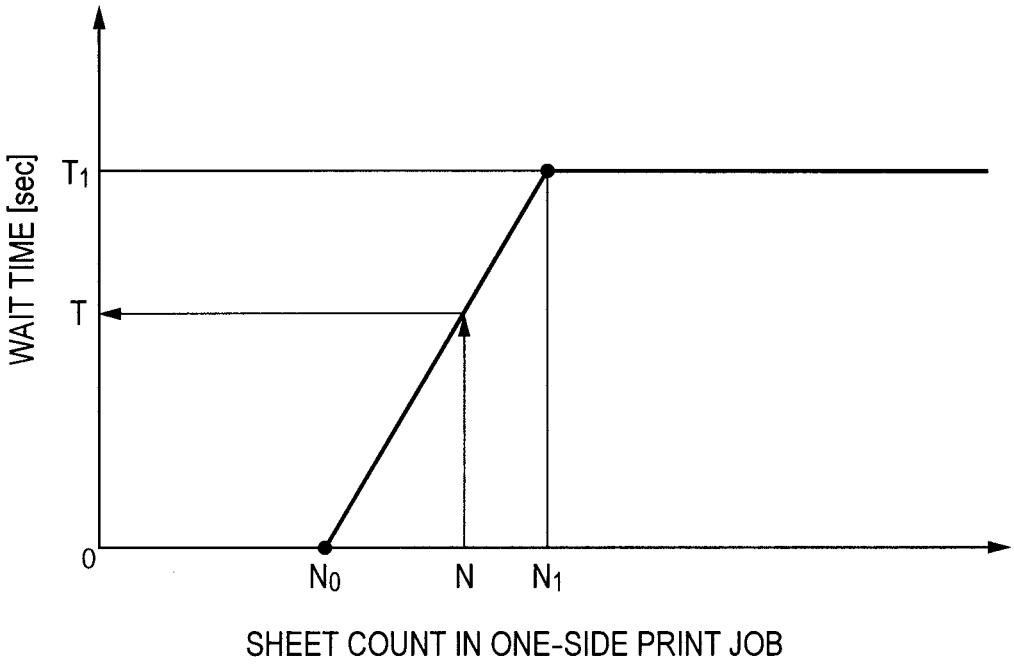
FIG. 6 illustrates a relationship between a sheet count in a one-side print job and wait time.

FIG. 6 illustrates a relationship between a sheet count in one-side print job and wait time. In FIG. 6, the abscissa axis represents a sheet count in a one-side print job and the ordinate axis represents wait time for starting a two-side print job. It is expected that for a short period of time just after the start of a one-side print job, water vapor around the switchback roller pair 14 and the switching member 13 continue increasing without condensing, and when the number of sheets in the one-side print job exceeds $N_0$, saturation occurs and the dew condensation begins. Until the number of sheets in the one-side print job exceeds $N_0$, that is, the number of sheets with an image formed on one side thereof in the one-side print job is less than a predetermined number, no wait time is required. Consequently, if the threshold value $C_0$ is set to be large to some extent relative to the water vapor generation amount $\Delta C_1$ per unit sheet count, the wait time is 0 when the number of sheets in a one-side print job is less than or equal to $N_0$.

When the number of sheets in one-side print job is greater than or equal to $N_0$, wait time T increases according to the number of sheets in the one-side print job. In other words, when the number of sheets in the one-side print job is N ($N_0 \leq N < N_1$), wait time T is time according to the number of sheets in the one-side print job. Meanwhile, as the number of sheets in a one-side print job increases exceeding $N_0$, the condensation amount also increases. When the number of sheets in a one-side print job is greater than or equal to $N_1$, the water vapor condensation amount $\Delta C_1$ and the amount $\Delta C_2$ of water vapor discharged to the outside of the apparatus and evaporated condensation reach a state of equilibrium, and therefore, it is expected that the condensation amount becomes constant. In other words, if the number of sheets in one-side print job is greater than or equal to $N_1$, the wait time can be made to be constantly $T_1$. In the present embodiment, for a one-side print job for a number of sheets greater than or equal to a certain number, fixed wait time $T_1$ is provided regardless of the number of sheets in the print job.

For two-side printing, in a state in which water vapor condenses, the wait time T is provided to retard a timing for starting feeding a sheet compared to that in the preceding one-side print job. Thereby, droplets can be prevented from adhering on the surface of the sheet S.

As described above, in the present embodiment, in two-side printing, as the number of sheets with a toner image formed on one side thereof in the one-side print job increases, the timing for starting a sheet feed operation is retarded compared to the timing for forming a toner image on one side of a sheet. In other words, when starting a two-side print job after the end of a one-side print job, if the number of sheets with an image formed on one side thereof in the one-side print job is greater than or equal to a predetermined number, a sheet feed operation is started at a later timing after the end of the last sheet feed operation in the one-side print job. As the number of sheets in the one-side print job increases, an interval between the last sheet in the one-side print job and a first sheet in the two-side print job is increased.

Consequently, in two-side printing after one-side printing, two-side printing can be started after passage of optimum wait time according to the number of sheets in the one-side printing from the state in which water vapor W condenses on the switchback roller pair 14 and the switching member 13. As a result, droplets can be prevented from adhering to the surface of the sheet S, and occurrence of image dropouts due to a decrease in resistance of the sheet surface caused by the droplet adherence can be prevented during toner image transfer in the secondary transfer unit 30.

Figure 7:
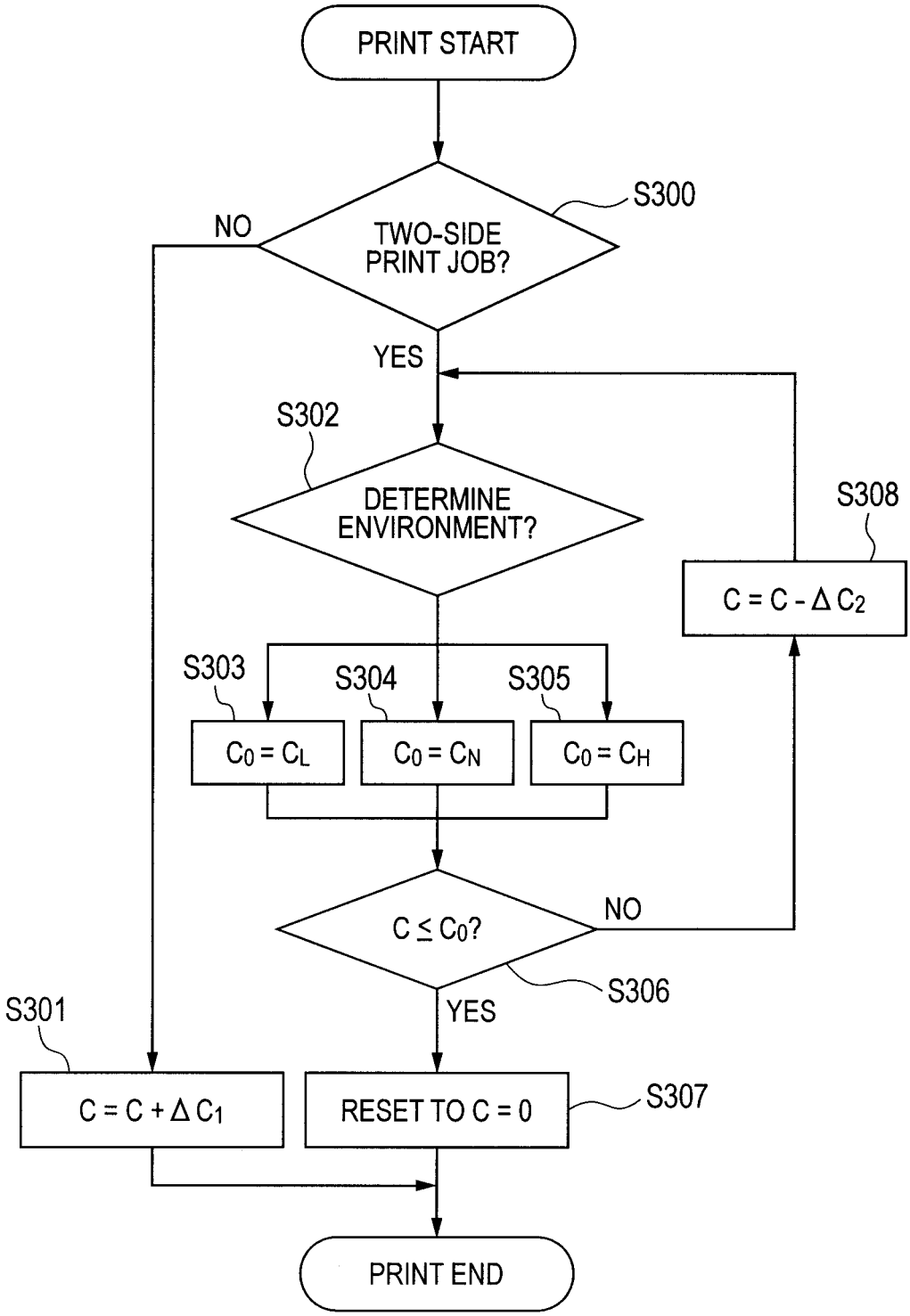
FIG. 7 illustrates a sequence, according to an amount of generated water vapor, for performing an image forming operation for two-side printing after the end of an image forming operation for one-side printing in an image forming apparatus according to a second embodiment of the present invention.

A second embodiment of the present invention will be described. FIG. 7 illustrates a sequence of an image forming apparatus according to the present embodiment, according to an amount of generated water vapor, when performing an image forming operation for two-side printing after the end of an image forming operation for one-side printing. The generated water vapor amount per unit sheet count and a water vapor condensation evaporation amount per unit time depend on the environment in which the printer body 1 is installed, due to factors such as the amount of moisture absorbed by the sheet S and a saturated water vapor amount for each temperature.

In the present embodiment, optimum wait time is set according to the environment in which the image forming apparatus body is installed. In the present embodiment, in order to detect the conditions of the environment in which the image forming apparatus body is installed, a temperature sensor 53 and a humidity sensor 54, which is illustrated in FIG. 8, are provided. The control unit 50 controls sheet feed operations in the feed cassette unit 5 and sheet transport operations in the re-transport unit 1D, and includes, e.g., a computing unit (not illustrated) that computes a value of the counter 51. The control unit 50 corrects a count value C based on the detection information (environment information) from the temperature sensor 53, which is a temperature detecting unit, and the humidity sensor 54, which is a humidity detecting unit. In the present embodiment, the following three threshold values $C_0$ ($C_{0L}$, $C_{0N}$ and $C_{0H}$) are set according to temperature and humidity.

Low temperature/low humidity, ordinary temperature/low humidity and high temperature/low humidity: $C_0=C_{0L}$ Low temperature/ordinary humidity, ordinary temperature/ordinary humidity and high temperature/ordinary humidity: $C_0=C_{0N}$ Low temperature/high humidity, ordinary temperature/high humidity and high temperature/high humidity: $C_0=C_{0H}$ A sequence, according to an amount of generated water vapor W, when performing an image forming operation for two-side printing after the end of an image forming operation for one-side printing in the present embodiment will be described with reference to FIG. 7. When the printer body 1A accepts a print job, the control unit 50 determines whether or not the accepted print job is one-side print job or two-side print job (S300). If the accepted print job is a one-side print job (No in S300), the water vapor generation amount $\Delta C_1$ per unit sheet count is added to the counter value C of the counter 51 for printing on every sheet. Consequently, the counter value C has a value of $C+\Delta C_1$ (S301). After the addition to the counter value C according to the number of sheets in the print job, the printing is terminated.

If the accepted print job is a two-side print job (Yes in S300), the control unit 50 determines the environment in which the image forming apparatus body is installed based on temperature information from the temperature sensor 53 and humidity information from the humidity sensor 54 (S302). Based on the determination, a threshold value $C_0$ is set according to the environment from among the three threshold values $C_0$ (S303, 5304 and S305).

The control unit 50 determines whether or not the counter value C is less than or equal to a threshold value $C_0$, which is a pre-set two-side print job start criterion, that is $C \leq C_0$ (S306). If the counter value C is less than or equal to the threshold value $C_0$ (Yes in S306), a two-side print job is carried out. After the end of the two-side print job, the control unit 50 resets the counter value C, that is, sets the counter value C to 0 (S307), and the printing is terminated.

If the counter value C exceeds the threshold value $C_0$, this means that water vapor W condenses on a switchback roller pair 14, etc. Accordingly, the control unit 50 deducts a condensation evaporation amount $\Delta C_2$ per unit time from the counter value C without performing the two-side print job. Accordingly the counter value C has a value of $C-\Delta C_2$ (S308).

Figure 9:
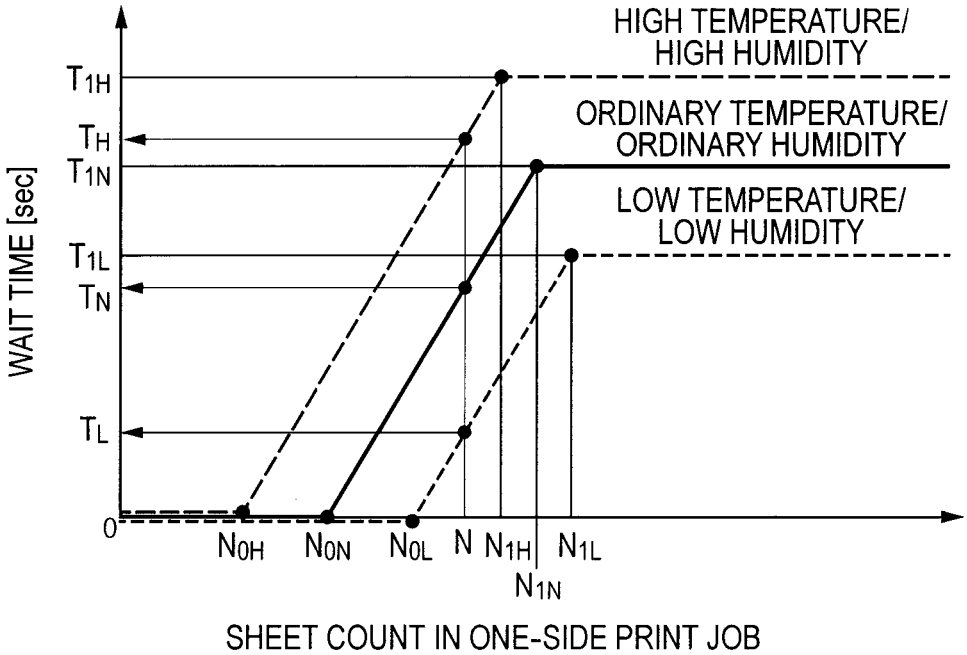
FIG. 9 illustrates a relationship between a sheet count in a one-side print job, and wait time for a first sheet in a two-side print job following the one-side print job.

FIG. 9 illustrates a relationship between a sheet count in a one-side print job, and wait time for a first sheet in two-side printing print job following the one-side print job. In FIG. 9, the abscissa axis represents a sheet count in a one-side print job, and the ordinate axis represents wait time when starting a two-side print job. In the present embodiment, the threshold values $C_0$ are set according to the respective environments, and therefore, a sheet count $N_0$ in one-side printing in which wait time is set to 0 seconds also varies depending on the environment as indicated below.

Low temperature/low humidity, ordinary temperature/low humidity and high temperature/low humidity: $N_0=N_{0L}$ Low temperature/ordinary humidity, ordinary temperature/ordinary humidity and high temperature/ordinary humidity: $N_0=N_{0N}$ Low temperature/high humidity, ordinary temperature/high humidity and high temperature/high humidity: $N_0=N_{0H}$ In the present embodiment, the relationship between the sheet counts $N_0$ in the respective environments is $N_{0L}>N_{0N}>N_{0H}$. In the sequence, as an environment is a higher temperature/higher humidity, wait time occurs even in a one-side print job for a smaller sheet count. This is because a sheet S before printing generally holds an amount of moisture according to the environment in which the image forming apparatus body is installed and thus, as an environment is a higher humidity, a large amount of water vapor W is generated. In a space around the switchback roller pair 14 and the switching member 13 immediately after the end of one-side printing, the effect of the temperature of the fixing unit 11 is dominant, and the effect of the temperature of the environment in which the image forming apparatus body is installed is small. In a high temperature/high humidity environment, an amount of water vapor W generated from a sheet S is large, and therefore, the natural phenomenon that water vapor W adhering to the switchback roller pair 14 and the switching member 13 is hardly dried can be expected with high accuracy.

In the present embodiment, when the number of sheets in a one-side print job exceeds a certain number, the amount of water vapor condensation and the amount of water vapor discharged to the outside of the apparatus and condensation evaporation reach a state of equilibrium, and therefore, it is expected that the condensation amount becomes constant. Thus, for a one-side print job for a number of sheets that is greater than or equal to a certain sheet count, fixed wait time is set according to the respective environments in which the image forming apparatus body is installed as follows, not depending on the number of sheets in the print job.

Low temperature/low humidity, ordinary temperature/low humidity and high temperature/low humidity: $T_1=T_{1L}$ Low temperature/ordinary humidity, ordinary temperature/ordinary humidity and high temperature/ordinary humidity: $T_1=T_{1N}$ Low temperature/high humidity, ordinary temperature/high humidity and high temperature/high humidity: $T_1=T_{1H}$ In the present embodiment, the relationship between the wait times for the respective environments is $T_{1H}>T_{1N}>T_{1L}$. This is because in a high temperature/high humidity environment, the amount of water vapor W generated from sheets S is large, requiring more wait time.

In the present embodiment, when two-side printing is performed in a state in which water vapor condenses, wait time T is provided and the timing for starting feeding sheets is retarded according to the environment in which the printer body 1 is installed compared to the timing in the preceding one-side print job. Consequently, in two-side printing after one-side printing, two-side printing can be started after passage of optimum wait time according to the number of sheet in the one-side printing and the environment in which the printer body 1 is installed, from the state in which water vapor W condenses on the switchback roller pair 14 and the switching member 13. As a result, image dropouts can be prevented from occurring due to a decrease in resistance of the surface of a sheet S caused by droplets adhering to the surface.

With digitalization and a multi-functionalization in recent years, in a case where, for example, an image reading unit is arranged at an upper portion of the printer body, the above-described water vapor discharge via a louver often becomes difficult because the image reading unit lies in the way. In the case of an apparatus of an inner-delivery type in which a sheet with an image formed thereon is delivered between the printer body and the image reading unit, it is effective to retard the timing for starting two-side printing like in the first and second embodiments in order to avoid the problem of droplets in two-side printing.

Also, in the case of an apparatus of an inner-delivery type in which a relay transport unit that transports a sheet with an image formed thereon to a sheet processing unit provided in a side portion of the printer body is provided in an in-body space, water vapor discharge via a louver becomes difficult due to the existence of the relay transport unit. Accordingly, the control to retard the timing for starting two-side printing like in the first and second embodiments in order to avoid the problem of droplets in two-side printing is effective also for a configuration including a relay transport unit.

Figure 10A:
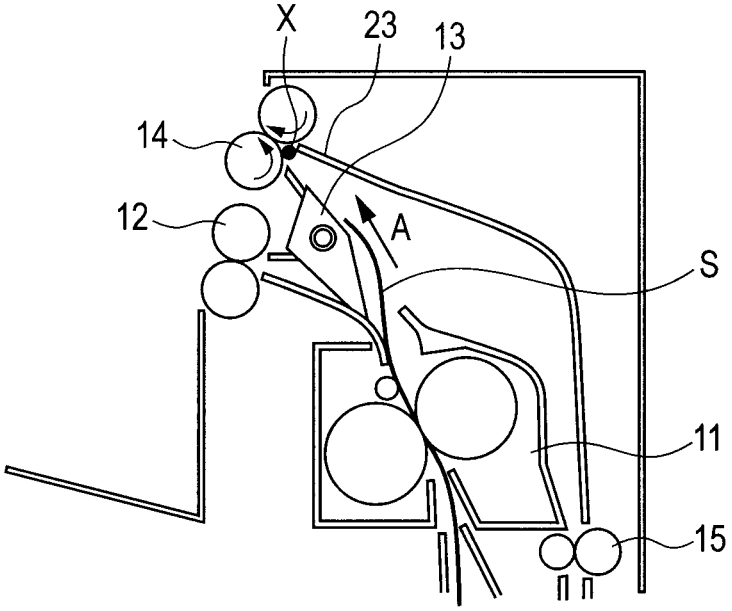
FIGS. 10A and 10B are enlarged views of a main part of an image forming apparatus according to a third embodiment of the present invention.
Figure 10B:
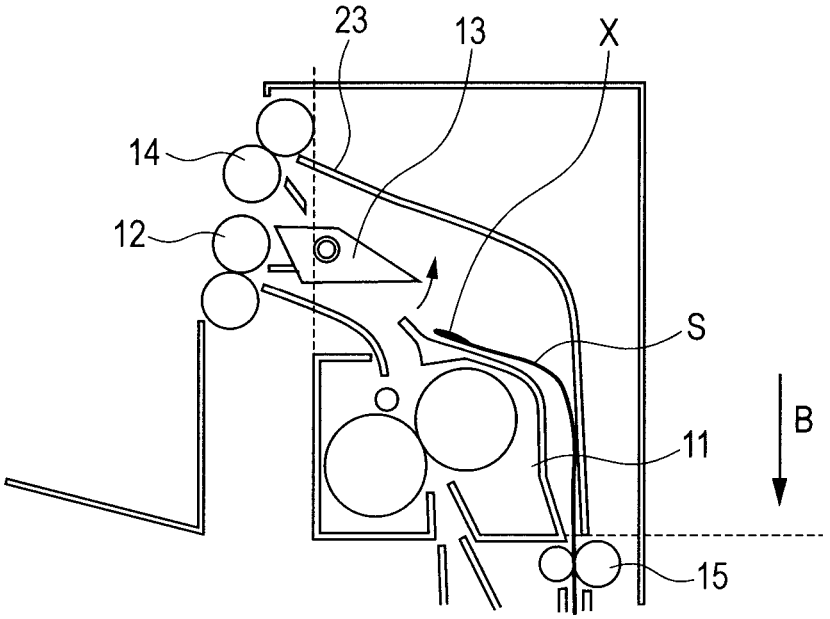

A third embodiment of the present invention will be described. FIGS. 10A and 10B are enlarged views of a main part of an image forming apparatus according to the present embodiment. In FIGS. 10A and 10B, symbols that are the same as those in FIG. 1 indicate the same or corresponding components.

FIG. 10A illustrates a state in which a sheet S with one side printed is transferred from a fixing unit 11 to a switchback roller pair 14 for two-side printing. In FIGS. 10A and 10B, droplets X are formed as a result of water vapor generated when fixing a toner image in the fixing unit 11, condensing after adhering to the switchback roller pair 14 and then converging on a nip portion of the switchback roller pair 14 by rotation of the switchback roller pair 14. Water vapor also adheres to and condenses on a lower surface of a reverse guide 23 provided above the fixing unit 11.

In two-side printing, a sheet S with an image formed on one side thereof is reversed and transported by the switchback roller pair 14. In this time, droplets X adhering to the nip portion of the switchback roller pair 14 and water vapor condensed on a lower surface of the reverse guide 23 adhere to the sheet S. The sheet S is transported in the direction indicated by arrow B illustrated in FIG. 10B by reverse rotation of the switchback roller pair 14. In particular, a sheet S to be reversed and transported often has droplets X adhering around a forward edge of the sheet S, which becomes a trailing edge of the sheet S after the sheet is reversed.

In the present embodiment, as illustrated in FIG. 10B, when the trailing edge of the sheet S with droplets X adhering thereto is positioned in the vicinity of the fixing unit 11 regardless of the sheet size, the transport of the sheet S is temporarily halted. When the sheet S is halted, the sheet S is heated because the area in the vicinity of the fixing unit 11 has a high temperature. As a result, the droplets X adhering to the sheet S can be evaporated. When consecutively forming an image on a plurality of sheets in a print job for two-side printing, a following sheet is not temporarily halted as opposed to a first sheet in the print job for two-side printing, or is halted only for a period of time shorter than the halt time of the first sheet and then the transport of the sheet is resumed.

Subsequently, the sheet S is halted for a predetermined period of time, and the transport of the sheet S is resumed after the adhered droplets X are evaporated such that the adhered droplets X do not affect transfer to the back side of the sheet S. The sheet S is transported through a registration roller pair 8 to an image forming unit 1B and printing is performed on the back side. When the sheet S is transported to the image forming unit 1B, the droplets X adhering to the sheet S have been evaporated, enabling prevention of image defects caused by the droplets X.

As described above, in the present embodiment, when performing two-side printing, a sheet S is temporarily halted in the vicinity of the fixing unit 11 to evaporate droplets adhering to the sheet S. As a result, image droplets can be prevented from occurring as a result of a decrease in resistance of a sheet surface owing to droplets adhering to the sheet surface. For example, when the reverse guide 23 has a high temperature, a similar effect can also be provided by decreasing the sheet transport speed to transport the sheet at a low speed, without halting the sheet S in the vicinity of the fixing unit 11.

A fourth embodiment of the present invention will be described. In the present embodiment, as in the above-described third embodiment, in two-side printing, when a trailing edge of a sheet S comes to the vicinity of a fixing unit, the transport of the sheet S is halted to evaporate droplets adhering to the sheet S. The halt time is changed according to the number of sheets in immediately-preceding one-side printing.

For example, when two-side printing is performed after one-side consecutive printing on a small number of sheets, water vapor adhering to the switchback roller pair 14 and the reverse guide 23 does not converge to form droplets. Accordingly, where the number of sheets in one-side consecutive printing is small, no image defects are caused even though the sheet S is not halted for a certain period of time in the vicinity of the fixing unit 11.

Figure 11:
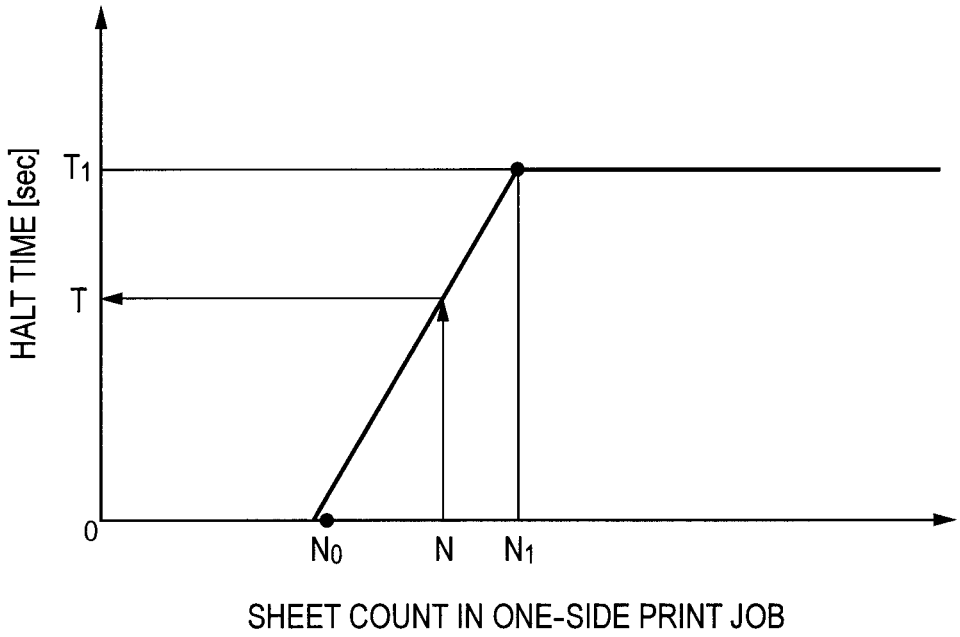
FIG. 11 illustrates a relationship between a consecutive printing count in a one-side print job and halt time in an image forming apparatus according to a fourth embodiment of the present invention.

FIG. 11 illustrates a relationship between the number of sheets in one-side consecutive printing and halt time. In FIG. 11, the abscissa axis represents the number of sheet in a one-side print job, and the ordinate axis represents halt time (wait time) during which a sheet is halted in the vicinity of the fixing unit 11 in a two-side print job. As illustrated in FIG. 11, until the number of sheets subjected to consecutive printing in a one-side print job reaches $N_0$, the wait time is 0 seconds, and when the number of sheets subjected to consecutive printing in a one-side print job is greater than or equal to $N_1$, the wait time is $T_1$ seconds. Furthermore, when the number of sheets subjected to consecutive printing in a one-side print job is N ($N_0 \leq N < N_1$), the wait time is T seconds according to the number of sheets subjected to consecutive printing in the one-side print job.

Figure 12:
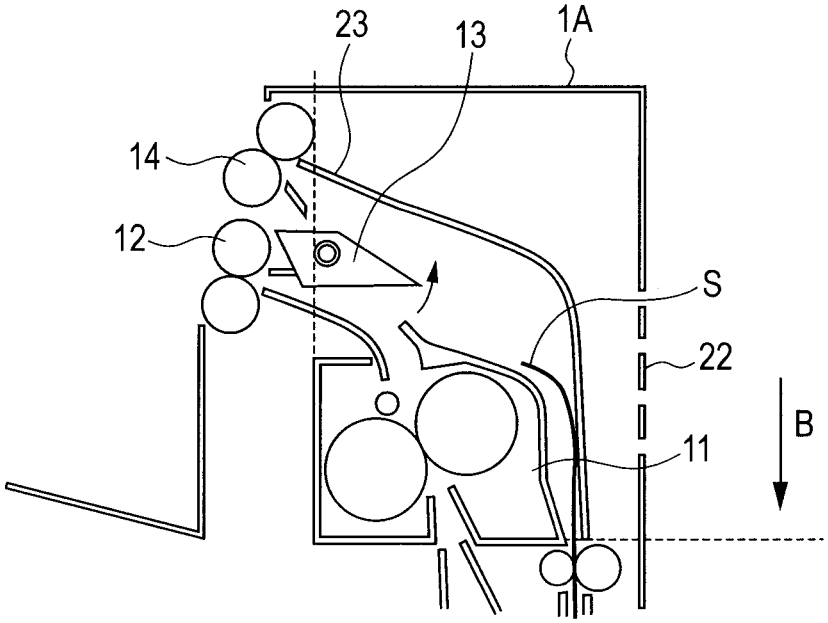
FIG. 12 is an enlarged view of a main part of the image forming apparatus.

In the present embodiment, when a trailing edge of a sheet S with droplets X adhering thereto is positioned in the vicinity of the fixing unit 11, the above-described control unit 50, as illustrated in FIG. 12, temporarily halts the sheet S in the vicinity of the fixing unit 11 for a period of time according to the number of sheets S subjected to the one-side printing. As a result of temporarily halting the sheet S for a period of time according to the number of sheets S subjected to the one-side printing, droplets X adhering to the sheet S can be evaporated such that the droplets X do not affect transfer of a toner image to a back side thereof.

In the present embodiment, as illustrated in FIG. 12, openings 22, which connected to the outside, are provided in an exterior portion of the printer body 1A positioned in the vicinity of the fixing unit 11. With the openings 22, the space in the vicinity of the fixing unit 11 has a temperature and humidity that are the same as that of the outside. Provision of the openings 22 enables efficient discharge of water vapor resulting from evaporation when the sheet is temporarily halted. As a result, moisture can efficiently evaporated without reaching a saturated humidity in the apparatus. Also, moisture can be prevented from building up in another area within the apparatus.

As described above, in the present embodiment, in two-side printing, sheet transport operation of the re-transport unit 1D is controlled so as to temporarily halt a sheet S in the vicinity of the fixing unit 11 for a period of time according to the number of sheets subjected to one-side printing to evaporate droplets adhering to the sheet S. Consequently, the droplets X adhering to the sheet S can be evaporated such that the droplets X do not affect transfer of a toner image to the back side of the sheet S, and thus, image defects caused by the droplets X can be prevented. Even with the configuration as described above, when two-side printing is consecutively performed after one-side printing, droplets X adhere to a first sheet S. Accordingly, second and onward sheets S are consecutively transported without being halted in the vicinity of the fixing unit 11.

Figure 13:
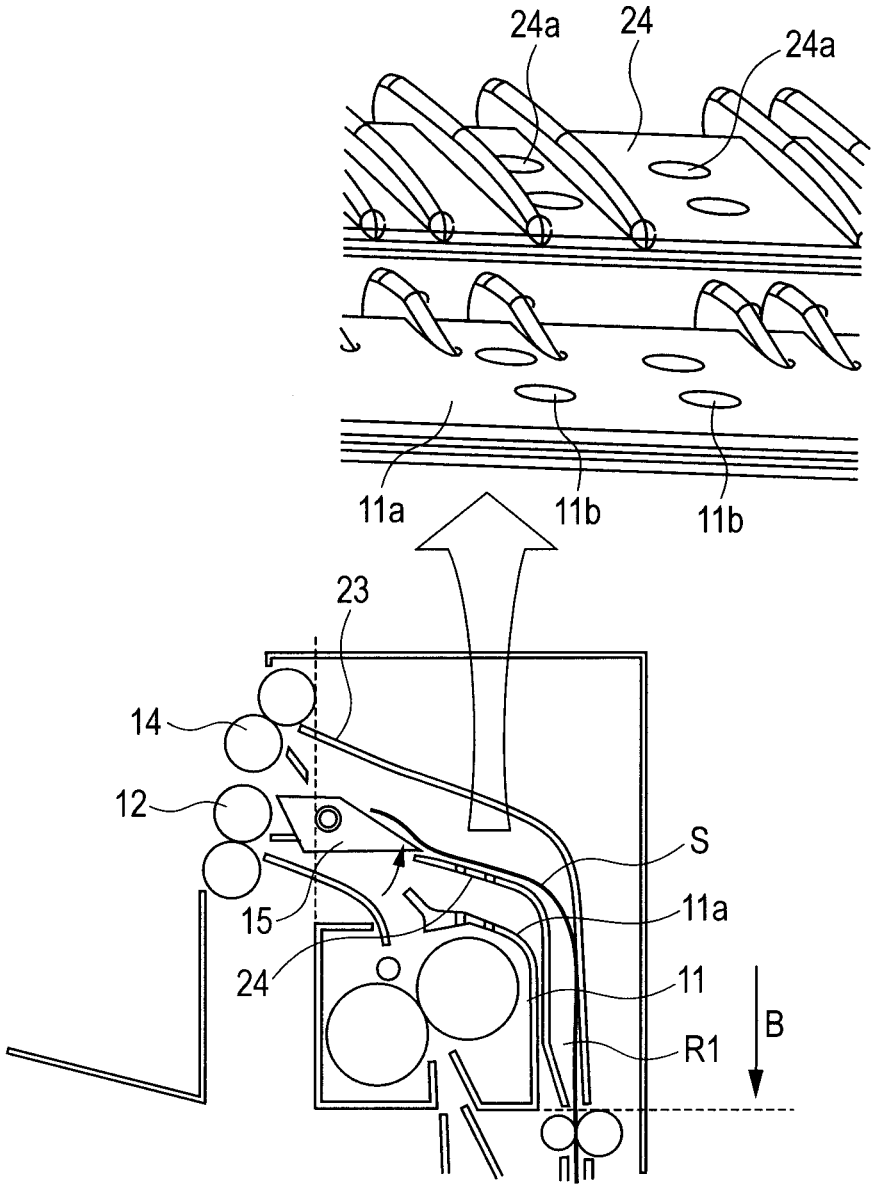
FIG. 13 is an enlarged view of a main part of an image forming apparatus according to a fifth embodiment of the present invention.

A fifth embodiment of the present invention will be described. FIG. 13 is an enlarged view of an image forming apparatus according to the present embodiment. In FIG. 13, symbols that are the same as those in FIG. 1 denote same or corresponding components.

In FIG. 13, a lower reverse guide 24 guides a sheet S reversed and transported by reverse rotation of a switchback roller pair 14 to a re-transport path R1 jointly with a reverse guide 23. In the present embodiment, a plurality of vents 11*b* is formed in an upper cover 11*a* of a fixing unit 11 and a plurality of vents 24*a* is formed in the lower reverse guide 24. As a result of providing the vents 11*b* in the upper cover 11*a* and providing the vents 24*a* in the lower reverse guide 24, respectively, the re-transport path R1 and the fixing unit 11 are communicated with each other.

In the present embodiment, the vents 11*b* and 24*a* form a communication portion that provides communication between the re-transport path R1 and the fixing unit 11. As a result of forming the vents 11*b* in the upper cover 11*a* and forming the vents 24*a* in the lower reverse guide 24, respectively, when a sheet S passes between the reverse guide 23 and the lower reverse guide 24, warm air from the fixing unit 11 is blown against the sheet S. Consequently, droplets adhering to the sheet S are partially evaporated.

In the present embodiment, also, the sheet S is temporarily halted in the vicinity of the fixing unit 11 for a period of time according to the number of sheets subjected to one-side printing, and then transport of the sheet S is resumed. When the sheet S is halted in the vicinity of the fixing unit 11, droplets adhering to the sheet have been partially evaporated, and thus, the halt time for the sheet can be shortened.

As described above, in the present embodiment, in two-side printing, droplets adhering to a sheet S are partially evaporated by warm air from the fixing unit 11. Subsequently, the sheet is temporarily halted in the vicinity of the fixing unit 11 to evaporate the droplets adhering to the sheet S. Consequently, the droplets X adhering to the sheet S can be evaporated such that the droplets X do not affect transfer of a toner image to the back side of the sheet S. Accordingly, image defects caused by the droplets X can be prevented. Even with the configuration as described above, when consecutive two-side printing is performed after one-side printing, droplets X adhere to a first sheet S. Therefore, second and onward sheets S are transported consecutively without being halted in the vicinity of the fixing unit 11.

Figure 14:
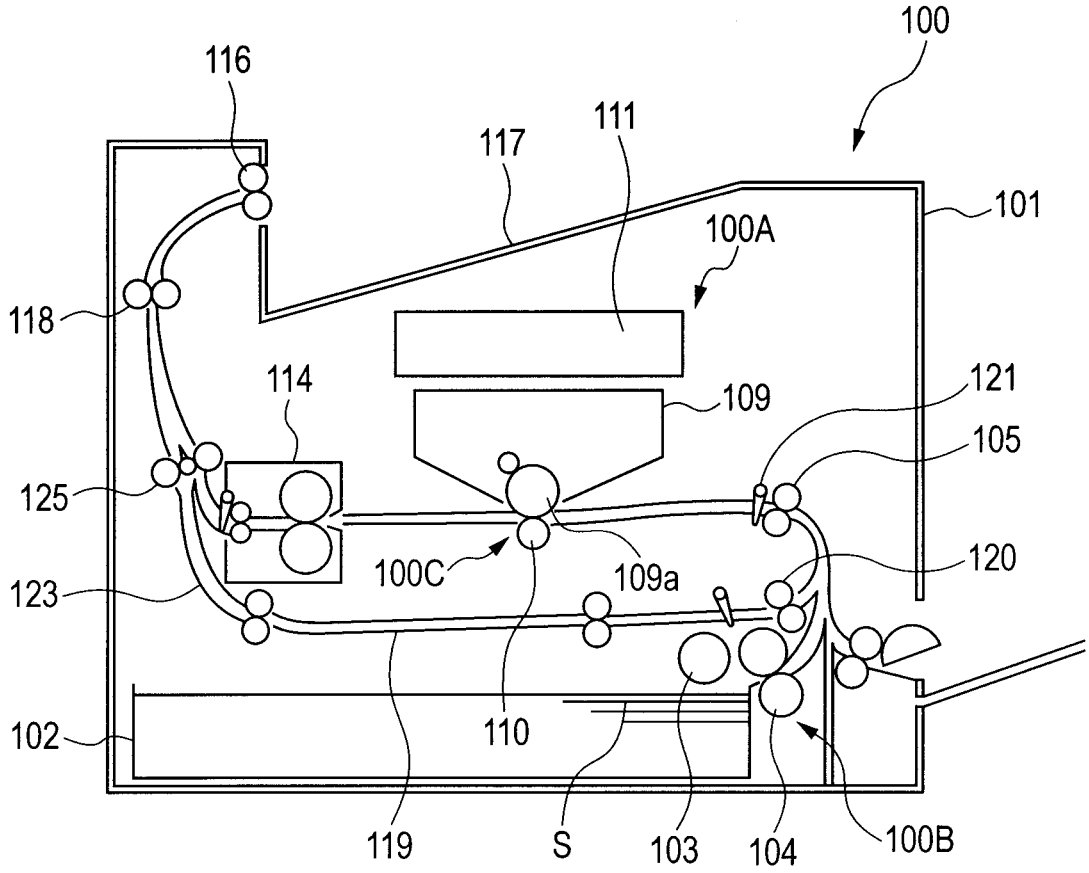
FIG. 14 illustrates a schematic configuration of a monochrome printer, which is an example of an image forming apparatus according to a sixth embodiment of the present invention.

A sixth embodiment of the present invention will be described. FIG. 14 illustrates a schematic configuration of a monochrome printer, which is an example of an image forming apparatus according to the present embodiment. In FIG. 14, a monochrome printer 100 and a monochrome printer body (hereinafter referred to as "printer body") 101 are illustrated. The monochrome printer 100 includes an image forming unit 100A and a sheet feed unit 100B that feeds a sheet to the image forming unit 100A, and a transfer unit 100C that transfers a toner image on a sheet. The monochrome printer 100 also includes, e.g., a fixing unit 114 that fixes a toner image transferred to a sheet in the transfer unit 100C to the sheet.

The image forming unit 100A includes a process cartridge 109 including, e.g., a photosensitive drum 109*a*, a charge roller, a developer sleeve and a toner container (which are not illustrated), and a laser scanner 111 that exposes a surface of the photosensitive drum 109*a* to form an electrostatic latent image on the photosensitive drum. The sheet feed unit 100B includes a feed cassette 102 that stacks sheets S therein, and a pickup roller 103 that feeds the sheets S in the feed cassette one by one. The transfer unit 100C includes the photosensitive drum 109*a*, and a transfer roller 110 that is brought into pressure-contact with the photosensitive drum 109*a* to form a transfer nip and transfers a toner image on the photosensitive drum 109*a* to the sheet when a sheet passes by the transfer nip.

An image forming operation in the monochrome printer 100 will be described. Upon input of image information from an external information apparatus such as a personal computer, laser light is emitted from the laser scanner 111 based on the input information. The laser light is irradiated to the photosensitive drum 109*a* that rotates clockwise. Consequently, an electrostatic latent image is formed on the photosensitive drum 109*a* uniformly charged at a predetermined polarity and potential by the charge roller (not illustrated). With rotation of the developer sleeve (not illustrated), adequately-charged toner is supplied onto the photosensitive drum 109*a* and adheres to the electrostatic latent image. Consequently, the electrostatic latent image is developed and visualized as a toner image.

In parallel to the toner image formation operation, sheets S stacked in the feed cassette 102 are sequentially sent out by a pickup roller 103 one by one, stating from an uppermost one. Subsequently, the sheets S are separated one by one by a retard roller pair 104, and then transported to a registration roller pair 105 whose rotation has been halted. A forward edge of a sheet S that has reached the registration roller pair 105 hits a nip of a registration roller pair 105. Subsequently, the sheet S is transported until the sheet S forms a predetermined loop and is subjected to skewing correction.

The sheet S subjected to skewing correction by the registration roller 105 is transported to the transfer unit 100C by the registration roller pair 105 in line with a timing for an image to be drawn out, while the size of the sheet S is determined by sheet size detecting unit 121. A toner image formed on a photosensitive drum in the transfer unit 100C is transferred to a predetermined position of the sheet by a transfer roller 110.

The sheet S to which the toner image has been transferred is transported to the fixing unit 114. In the fixing unit 114, the unfixed toner image is heated and pressurized to be fixed to the sheet surface. After the fixing of the toner image, in the case of one-side printing, the sheet S is transported from the fixing unit 114 by a triple roller pair 125 and a switchback roller pair 118. Subsequently, the sheet is delivered onto a delivery tray 117 by a delivery roller 116, with the printed side down.

Figure 15:
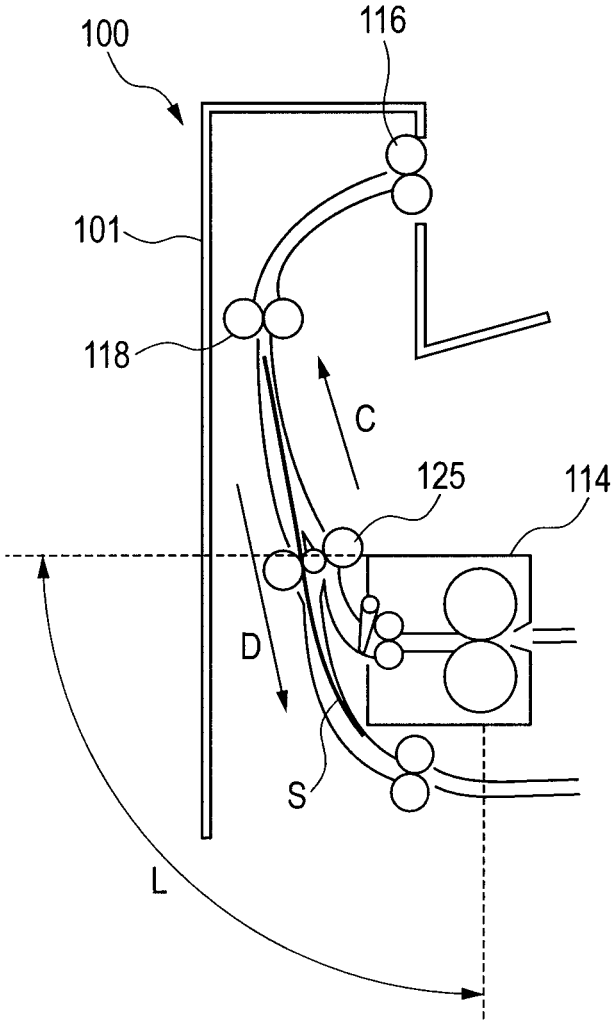
FIG. 15 illustrates an enlarged view of a main part of the monochrome printer.

The monochrome printer 100 can form an image on both sides of a sheet. When performing two-side printing on a sheet S, as illustrated in FIG. 15, the sheet S to which a toner image has been fixed by the fixing unit 114 is temporarily transported in the direction of arrow C. After a trailing edge of the sheet S has passed through the triple roller pair 125, the sheet S is transported in the direction of arrow D by reversely rotating the switchback roller pair 118, and transported to a re-feed transport path 119 for backside printing.

The sheet S transported into the re-feed transport path 119, as illustrated in FIG. 14, is nipped by a re-feed roller pair 120 provided in the re-feed transport path 119, and then temporarily halted to be subjected to correction for forward-edge registration. Subsequently, the sheet S waits for a print signal for back-side printing to come at that position. When the printer body 101 receives a print signal for back-side printing, the re-feed roller pair 120 is rotated to transport the sheet S waiting in the re-feed transport path 119 to the registration roller pair 105. The sheet S is transported to the image forming unit 100A via the registration roller pair 105 and is subjected to back-side printing. Subsequently, the sheet S is delivered onto the delivery tray 117 by a delivery unit 116.

When one-side printing is consecutively performed in the monochrome printer 100 with the above-described configuration, a large amount of water vapor adheres to a reverse guide 123 and condenses there, thereby forming droplets. After one-side consecutive printing, if two-side printing is performed before the droplets are evaporated, the droplets adhering to the reverse guide 123 adhere to the sheet S that has been transported there. A part of a sheet S to which droplets particularly often adhere is a part around an forward edge of the sheet S which is reversed and transported in the direction of arrow D by the switchback roller pair 118 in two-side printing.

The reversed and transported sheet S is transported to the re-feed transport path 119. Regardless of the sheet size, when the forward edge of the sheet S with droplets adhering thereto comes to a position in a vicinity L of the fixing 114, as illustrated in FIG. 15, the transport is temporarily halted and waits for evaporation of the droplets adhering to the sheet S. In the vicinity of the fixing 114, the reverse guide 123 has a high temperature, enabling evaporation of the droplets adhering to the sheet S. The sheet S is halted for a predetermined period of time, and the transport of the sheet S is resumed after the adhered droplets are evaporated such that the droplets do not affect transfer to the back side of the sheet S, and the sheet S is sent to the re-feed roller pair 120. Subsequently, the sheet S is subjected to back-side printing and then delivered onto the delivery tray 117 by the delivery unit 116, thereby preventing image defects caused by the droplets.

An image forming apparatus having a configuration that is different from those in the above-described first to fifth embodiments also can prevent image defects caused by droplets, by temporarily halting a sheet in the vicinity of the fixing unit 114 in two-side printing, thereby evaporating droplets adhering to the sheet S. A similar effect can also be provided by transporting a sheet S at a low speed in the vicinity L of the fixing 114.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-251391, filed Oct. 30, 2009, which is hereby incorporated by reference herein in its entirety.

What is claimed is:

1. An image forming apparatus comprising:

a sheet feed unit that feeds a sheet to an image forming unit forming a toner image on the sheet;

a fixing unit that fixes the toner image to the sheet;

a re-transport unit that reverses the sheet with the toner image and re-transports the sheet to the image forming unit when forming an image on both sides of the sheet;

a recognition unit that recognizes the number of sheets in a one-side image formation;

a timer that detects passage of time; and a control unit that controls a sheet feed operation of the sheet feed unit based on the number of sheets recognized by the recognition unit, wherein, when starting the duplex image formation after the one-side image formation, in a case where the number of the sheets recognized by the recognition unit in the one-side image formation is less than a predetermined number, the control unit controls the sheet feed unit so as to start the sheet feed operation when passage of a first time is detected by the timer after the end of the sheet feed operation for feeding the last sheet in the one-side image formation, and in a case where the number of the sheets recognized by the recognition unit in the one-side image formation is greater than or equal to the predetermined number, the control unit controls the sheet feed unit so as to start the sheet feed operation when passage of a second time which is longer than the first time is detected by the timer after the end of the sheet feed operation for feeding the last sheet in the one-side image formation.

2. The image forming apparatus according to claim 1, wherein, in the one-side image formation, the control unit controls the sheet feed unit so as to perform the sheet feed operation at predetermined time intervals; and wherein, when starting the duplex image formation after the one-side image formation, in a case where the number of the sheets recognized by the recognition unit with the image formed on the one side thereof in the one-side image formation is greater than or equal to the predetermined number, the control unit controls the sheet feed unit so as to start the sheet feed operation for feeding the first sheet in the duplex image formation at a timing later than the elapse of one of the predetermined time intervals after the end of the sheet feed operation for feeding the last sheet in the one-side image formation.

3. The image forming apparatus according to claim 2, wherein, when starting the duplex image formation after the one-side image formation, in a case where the number of the sheets recognized by the recognition unit with the image formed on the one side thereof in the one-side image formation is less than the predetermined number, the control unit controls the sheet feed unit so as to start the sheet feed operation for feeding the first sheet in the duplex image formation when one of the predetermined time intervals has elapsed after the end of the sheet feed operation for feeding the last sheet in the one-side image formation.

4. The image forming apparatus according to claim 1, wherein, when starting the duplex image formation after the one-side image formation, a timing for starting the sheet feed operation is set based on an amount of water vapor generated from a sheet in the one-side image formation, and an estimated amount of water vapor condensed and then evaporated from the end of the one-side image formation until the start of the two-side image formation.

5. The image forming apparatus according to claim 1, further comprising:

a temperature detecting unit that detects a temperature of an environment in which a body of the image forming apparatus is installed; and a humidity detecting unit that detects a humidity of the environment in which the body of the image forming apparatus is installed, wherein the control unit sets a timing for starting the sheet feed operation when performing the duplex image formation based on temperature information from the temperature detecting unit and humidity information from the humidity detecting unit.

6. The image forming apparatus according to claim 1, wherein, when the control unit receives a job according to the duplex image formation after a predetermined time has elapsed from the end of the one-side image formation, the control unit causes the sheet feed unit to start the sheet feed operation for feeding the first sheet in the duplex image formation at a timing to receive the job.

7. An image forming apparatus comprising:

a sheet feed unit that feeds a sheet to an image forming unit forming a toner image on the sheet;

a fixing unit that fixes the toner image to the sheet;

a re-transport unit that reverses the sheet with the toner image and re-transports the sheet to the image forming unit when forming an image on both sides of the sheet;

a recognition unit that recognizes the number of sheets in a one-side image formation;

a timer that detects passage of time; and a control unit that controls a sheet feed operation of the sheet feed unit, wherein, when starting the duplex image formation after the one-side image formation, in a case where the number of the sheets recognized by the recognition unit in the one-side image formation is less than a predetermined number, the control unit controls the sheet feed unit so as to start the sheet feed operation when passage of a first time is detected by the timer after the end of the sheet feed operation for feeding the last sheet in the one-side image formation, and in a case where the number of the sheets recognized by the recognition unit in the one-side image formation is greater than or equal to the predetermined number, the control unit controls the sheet feed unit so as to start the sheet feed operation when passage of a second time which is different than the first time is detected by the timer after the end of the sheet feed operation for feeding the last sheet in the one-side image formation.

8. The image forming apparatus according to claim 7, wherein, in the one-side image formation, the control unit controls the sheet feed unit so as to perform the sheet feed operation at predetermined time intervals; and wherein, when starting the duplex image formation after the one-side image formation, in a case where the number of the sheets recognized by the recognition unit with the image formed on the one side thereof in the one-side image formation is greater than or equal to a predetermined number, the control unit controls the sheet feed unit so as to start the sheet feed operation for feeding the first sheet in the duplex image formation at a timing later than the elapse of one of the predetermined time intervals after the end of the sheet feed operation for feeding the last sheet in the one-side image formation.

9. The image forming apparatus according to claim 8, wherein, when starting the duplex image formation after the one-side image formation, in a case where the number of the sheets recognized by the recognition unit with the image formed on the one side thereof in the one-side image formation is less than the predetermined number, the control unit controls the sheet feed unit so as to start the sheet feed operation for feeding the first sheet in the duplex image formation when one of the predetermined time intervals has elapsed after the end of the sheet feed operation for feeding the last sheet in the one-side image formation.

10. The image forming apparatus according to claim 7, wherein, when starting the duplex image formation after the one-side image formation, a timing for starting the sheet feed operation is set based on an amount of water vapor generated from a sheet in the one-side image formation, and an estimated amount of water vapor condensed and then evaporated from the end of the one-side image formation until the start of the two-side image formation.

11. The image forming apparatus according to claim 7, further comprising:

a temperature detecting unit that detects a temperature of an environment in which a body of the image forming apparatus is installed; and a humidity detecting unit that detects a humidity of the environment in which the body of the image forming apparatus is installed, wherein the control unit sets a timing for starting the sheet feed operation when performing the duplex image formation based on temperature information from the temperature detecting unit and humidity information from the humidity detecting unit.

12. The image forming apparatus according to claim 7, wherein, when the control unit receives a job according to the duplex image formation after a predetermined time has elapsed from the end of the one-side image formation, the control unit causes the sheet feed unit to start the sheet feed operation for feeding the first sheet in the duplex image formation at a timing to receive the job.

13. An image forming apparatus comprising:

a sheet feed unit that feeds a sheet to an image forming unit forming a toner image on the sheet;

a fixing unit that fixes the toner image to the sheet;

a re-transport unit that reverses the sheet with the toner image and re-transports the sheet to the image forming unit when forming an image on both sides of the sheet;

a recognition unit that recognizes the number of sheets in a one-side image formation;

a timer that detects passage of time; and a control unit that controls a sheet feed operation of the sheet feed unit based on the number of sheets recognized by the recognition unit, wherein, when starting the duplex image formation after the one-side image formation, in a case where a number of the sheets recognized by the recognition unit in the one-side image formation is greater than or equal to a predetermined number, the control unit controls the sheet feed unit so as to start the sheet feed operation after a passage of a predetermined time from the end of the sheet feed operation for feeding the last sheet in the one-side image formation is detected by the timer, and in a case where the number of the sheets recognized by the recognition unit in the one-side image formation is less than the predetermined number, the control unit controls the sheet feed unit so as to start the sheet feed operation before the predetermined time passes from the end of the sheet feed operation for feeding the last sheet in the one-side image formation.

14. The image forming apparatus according to claim 13, wherein, when starting the duplex image formation after the one-side image formation, in a case where a number of the sheets recognized by the recognition unit in the one-side image formation is greater than or equal to the predetermined number, the control unit controls the sheet feed unit so as to start the sheet feed operation when the passage of a time according to the number of the sheets recognized by the recognition unit is detected by the timer.

* * * * *